US006948676B1

(12) United States Patent
Tremblay

(10) Patent No.: US 6,948,676 B1
(45) Date of Patent: Sep. 27, 2005

(54) METHOD OF WINDING ELECTRICAL AND ELECTRONIC COMPONENTS

(76) Inventor: John K. Tremblay, 10 King St., Peabody, MA (US) 01960

( * ) Notice: Subject to any disclaimer, the term of this patent is extended or adjusted under 35 U.S.C. 154(b) by 0 days.

(21) Appl. No.: 10/884,275

(22) Filed: Jul. 6, 2004

(51) Int. Cl.[7] ..... H01F 41/08; B65H 81/02

(52) U.S. Cl. ..... 242/434.7; 242/434.9; 242/434.5; 29/605

(58) Field of Search ..... 242/434.7, 434.8, 242/434.9, 434.5; 29/605, 737, 820

(56) References Cited

U.S. PATENT DOCUMENTS

| | | | | |
|---|---|---|---|---|
| 2,341,650 | A * | 2/1944 | Quinlan | 242/434.9 |
| 2,730,474 | A | 1/1956 | Finholt et al. | |
| 2,819,850 | A * | 1/1958 | Mathis | 242/434.5 |
| 3,985,310 | A | 10/1976 | Kent et al. | |
| 4,140,971 | A | 2/1979 | Blincoe | |
| 4,269,366 | A | 5/1981 | Lindenmeyer | |
| 4,288,041 | A | 9/1981 | Marzec et al. | |
| 4,467,972 | A * | 8/1984 | Kaiser | 242/434.7 |
| 4,548,365 | A | 10/1985 | Marzec et al. | |
| 4,771,957 | A | 9/1988 | Schlake et al. | |
| 4,779,812 | A | 10/1988 | Fisher et al. | |
| 4,812,812 | A | 3/1989 | Flowerdew et al. | |
| 4,821,422 | A | 4/1989 | Porter | |
| 4,856,721 | A | 8/1989 | Bonello et al. | |
| 4,872,618 | A | 10/1989 | Sato et al. | |
| 4,884,758 | A | 12/1989 | Hamkins | |
| 4,917,316 | A * | 4/1990 | Suzuki | 242/434.8 |
| 4,917,317 | A | 4/1990 | Iihama et al. | |
| 5,143,315 | A | 9/1992 | Faessel et al. | |
| 5,165,162 | A | 11/1992 | Charles | |
| 5,195,682 | A | 3/1993 | Rabinovich | |
| 5,274,907 | A | 1/1994 | Moorehead | |
| 5,331,729 | A | 7/1994 | Moorehead | |
| 5,394,046 | A | 2/1995 | Dolgas | |
| 5,507,442 | A | 4/1996 | Konno et al. | |
| 5,547,532 | A | 8/1996 | Wernersbach, Jr. et al. | |
| 5,573,200 | A * | 11/1996 | Sato et al. | 242/434.8 |
| 5,586,383 | A | 12/1996 | Dolgas et al. | |
| 5,709,353 | A | 1/1998 | Cattaneo et al. | |
| 5,813,996 | A | 9/1998 | St. Germain et al. | |
| 6,086,596 | A | 7/2000 | Durham | |
| 6,233,814 | B1 | 5/2001 | Bast et al. | |
| 6,254,027 | B1 | 7/2001 | Kunou | |
| 6,259,174 | B1 | 7/2001 | Ono | |
| 6,267,317 | B1 | 7/2001 | Beakes et al. | |

FOREIGN PATENT DOCUMENTS

| | | | | |
|---|---|---|---|---|
| JP | 03211807 A * | 9/1991 | | H01F 41/08 |

* cited by examiner

*Primary Examiner*—Kathy Matecki
*Assistant Examiner*—Evan H Langdon
(74) *Attorney, Agent, or Firm*—John P. McGonagle

(57) ABSTRACT

A method of forming a toroid coil on a toroidal body. Ferrous material is attached to conductive wire. Magnetic force is then used to manipulate the conductive wire about the toroid core.

9 Claims, 5 Drawing Sheets

METHOD OF WINDING ELECTRICAL AND ELECTRONIC COMPONENTS

BACKGROUND OF THE INVENTION

This invention relates generally to methods for winding wire on a workpiece, and in particular, to a method and apparatus for forming a toroid coil on a toroidal body.

Many applications require the use of conductive wire, ribbon or tape to be wound around various shaped objects and/or in various shaped patterns. A solenoid is comprised of an electric conductor wound as a helix with small pitch, or as two or more coaxial helices, so that current through the conductor establishes a magnetic field within the conductor. A specific type of solenoid is a wire wound toroid core which is frequently used in various types of electrical and electronic equipment.

In order to optimize the electromagnetic properties of a toroid core, it is formed as an unbroken toroidal body. However, the shape of toroidal cores makes them difficult to wind with automatic machinery. It is, therefore, a common practice to wind toroidal cores by hand. Yet, to provide large numbers of such cores at a reasonable cost, the use of machines in manufacture is mandated. Heretofore, the machines used for winding toroidal cores have been complex and expensive because of the number of parts required in such a machine as well as the wear and tear on such parts. Further, the rate of completion of the final product, a wound toroidal core, has been relatively slow.

SUMMARY OF THE INVENTION

The present invention addresses the above problems by attaching ferrous material to the conductive wire prior to the core winding operation. Magnetic force is then used to manipulate the conductive wire about the core rather than the complicated machinery of the prior art. The machinery that can be used is quite simple and the wear and tear on moving parts is substantially reduced.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
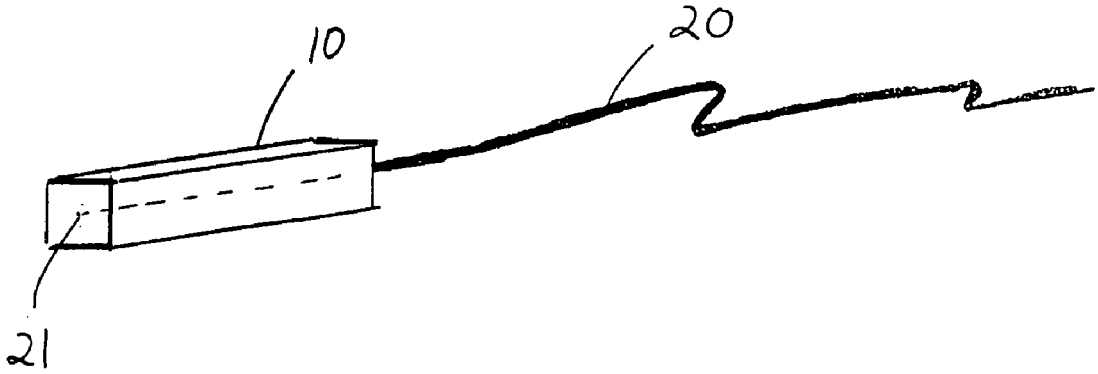
FIG. 1 is a perspective view of a conductive wire with ferrous block attached.
Figure 2A:
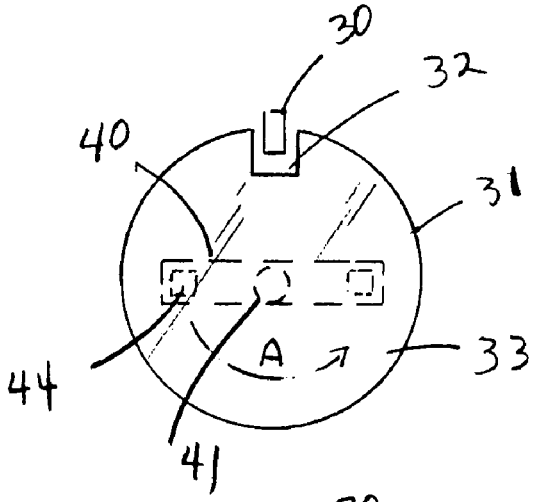
FIG. 2A is a top view of a manufacturing set up using the present invention.
Figure 2B:
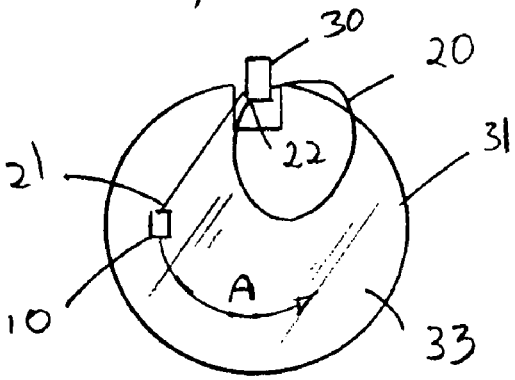
FIG. 2B is a top view of a manufacturing operation using the present invention.
Figure 3:
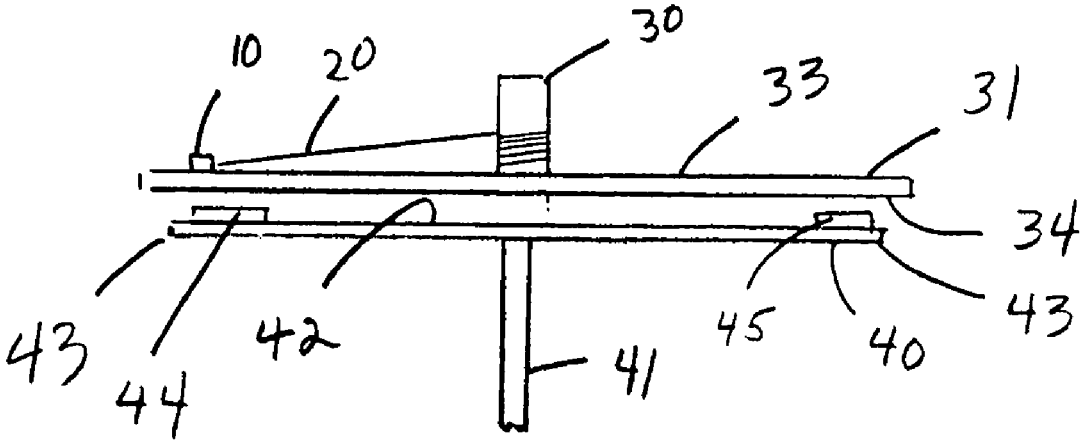
FIG. 3 is a side view of the manufacturing operation.
Figure 4:
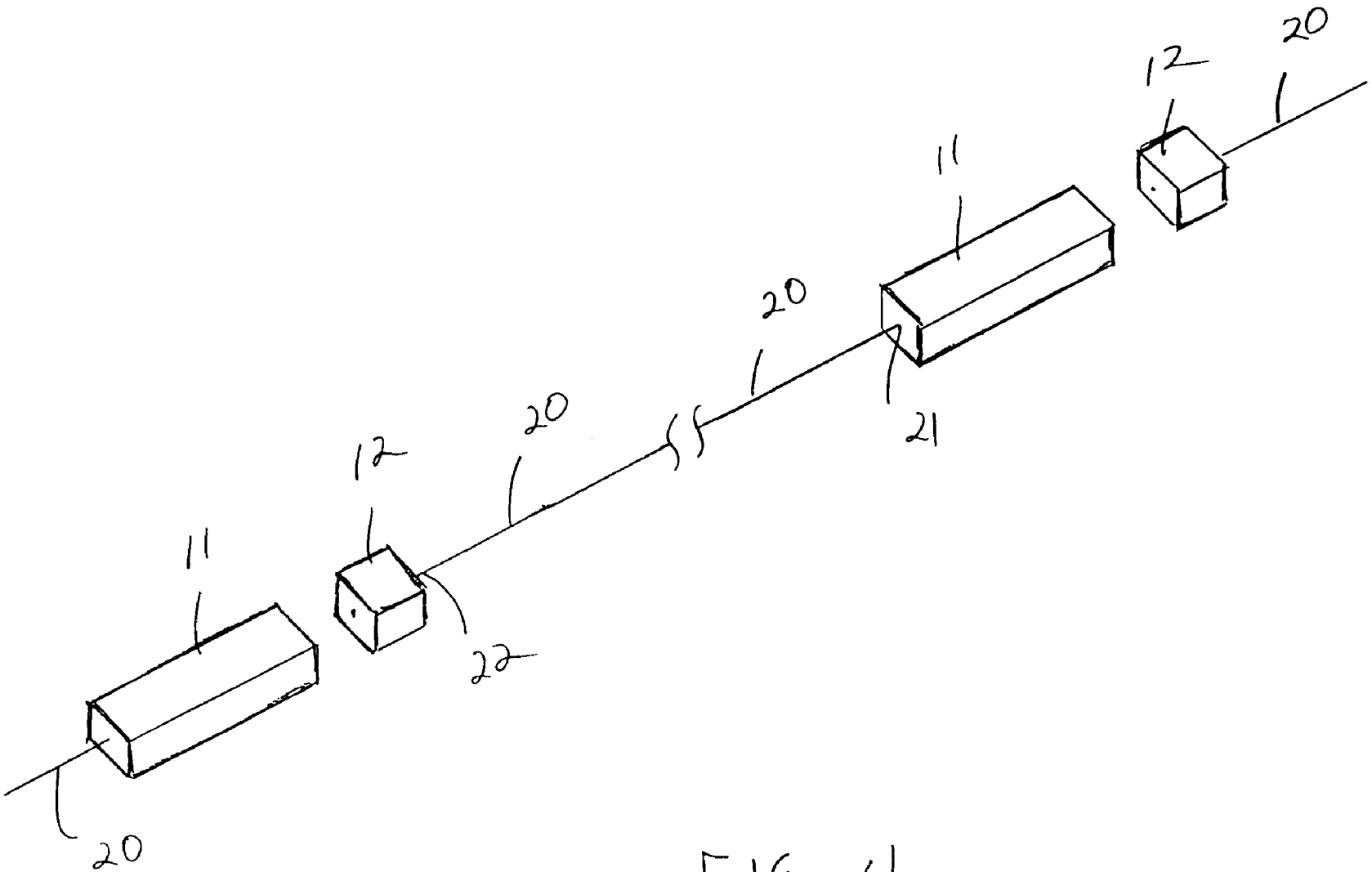
FIG. 4 is a perspective view of a conductive wire embodiment with two ferrous blocks attached.
Figure 5:
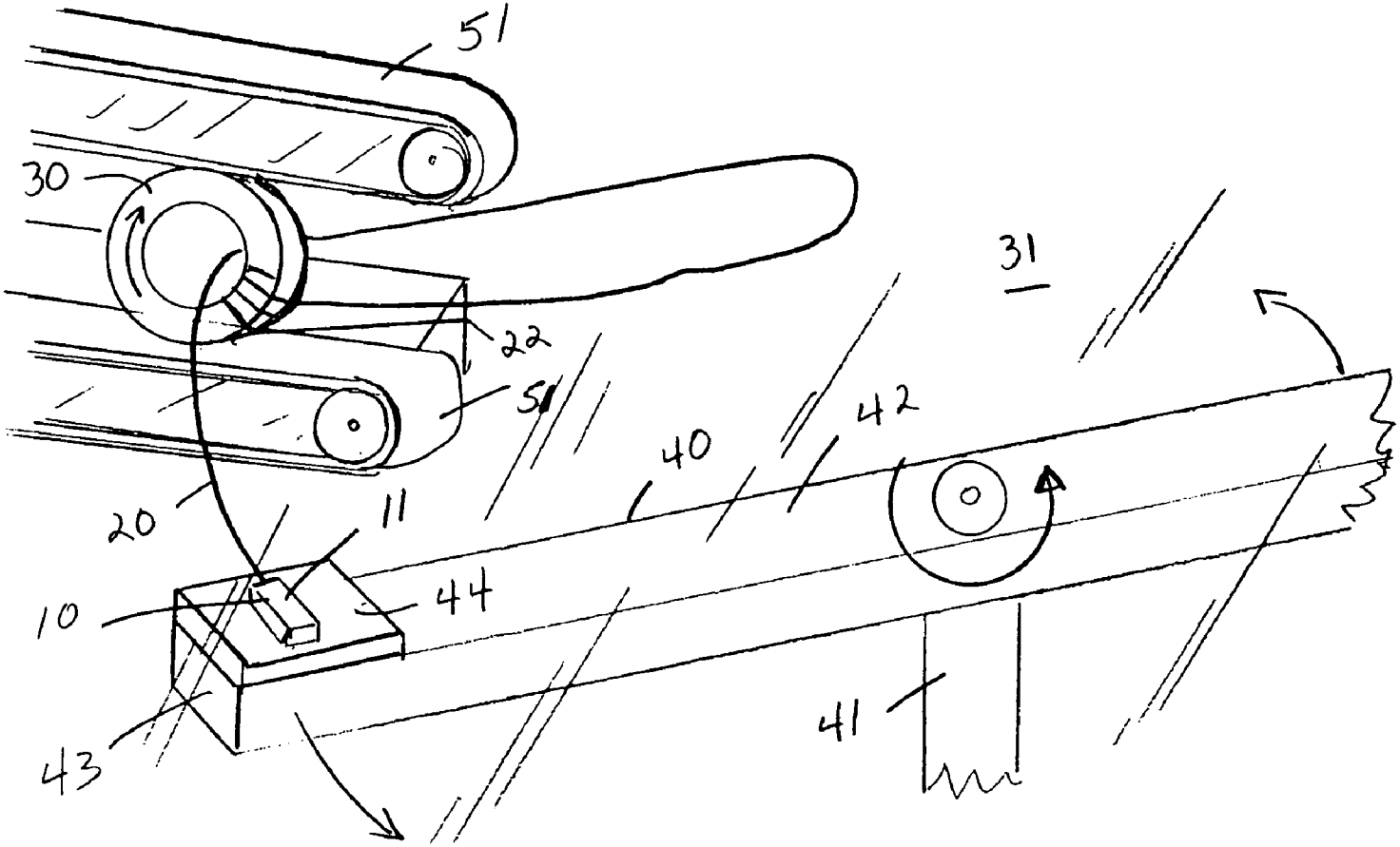
FIG. 5 is a close up view of the winding operation.
Figure 6:
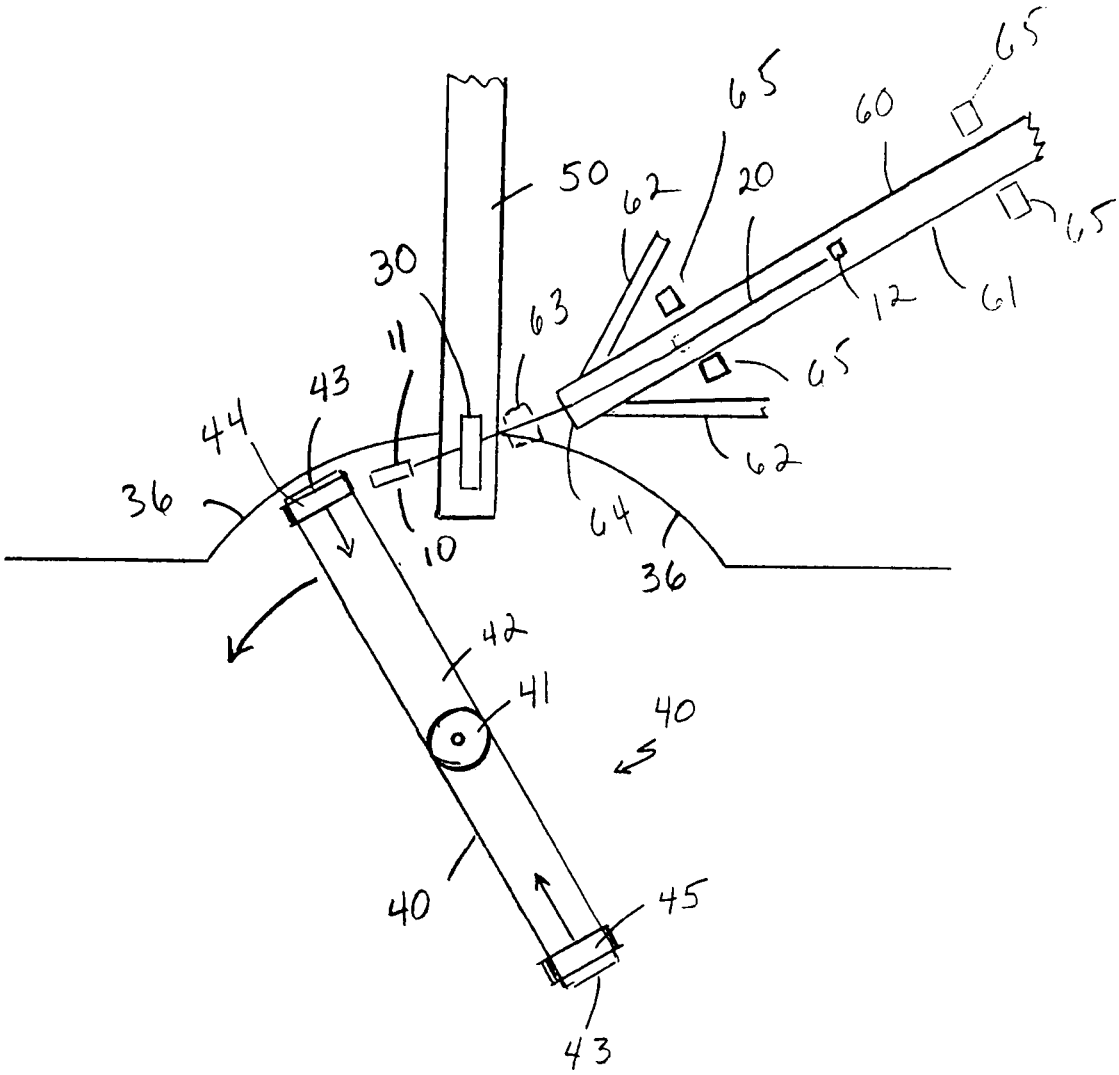
FIG. 6 is a close up top view of the manufacturing operation.

Referring to the drawings in detail wherein like elements are indicated by like numerals, there is shown a method for winding wire on a toroid core. Although typical conductive wire, such as copper, has some magnetic properties, these properties are generally too magnetically weak to allow a magnetic-based manufacturing operation, such as winding a toroidal core. The present invention addresses this problem by attaching a block 10 of ferrous material which has strong magnetic properties to a first end 21 of a conductive wire 20 thereby allowing the conductive wire to be manipulated with magnetic force. The present invention works best with very small toroids. Wire sizes would be in the 30AWG–60AWG range, with a preferred range of 35AWG–50AWG.

In one embodiment for attaching a block 10 of ferrous material to a conductive wire 20, a concentrated slurry of sponge iron powder in an adhesive is made. The preferred adhesive is acetate based. Forming the block 10 with a slurry of sponge iron powder with an acetate-based adhesive is fast and does not involve pressure that would distort magnetic domains as they are formed. The blocks 10 may also be formed with a non-toxic water based adhesive that would allow the blocks and scrap to be recycled. The slurry mixture is poured into a mold. The mold is approximately 0.750" long by 0.020" square. An end 21 of the conductive wire is passed into the mold on center along the mold's longitudinal axis. A magnetic field with a magnetic and polarization equal to the one to be used to manipulate the resultant conductive wire is then applied. The adhesive is cured under these conditions. A resulting ferrous block 10 with conductive wire end 21 attached is removed from the mold. This process allows the magnetic domains of the ferrous block 10 attached to the conductive wire 20 to be tuned to the magnetic field that will be used to manipulate the block 10 and the attached conductive wire. The rectangular shape of the polarized ferrous block 10 allows the block to more readily keep its orientation while moving. In an alternate process, a piece of iron butt may be welded to the end of the conductive wire. However, applicant has found that the second embodiment form offers only about 60% of the pull of the preferred embodiment.

In another embodiment of the invention, the block 10 is cut into a lead slug 11 and a trailing slug 12. The conductive wire 20 has a predetermined length and has the lead slug 11 attached to the wire first end 21 and the trailing slug attached to a wire second end 22. The wire 20 typically has a length range of nine to sixteen inches. One prepared wire, i.e., a wire 20 with a leading block 10 or slug 11 and a trailing wire end 22 with or without a trailing slug 12, is typically used for each toroid 30.

To wind the wire 20 about a toroid, a toroid 30 is placed in a holding assembly 50 adjacent a notched glass plate 31, the toroid 30 being positioned within the glass plate notch 32 and oriented vertically. The glass plate 31 has an upper surface 33 and a bottom surface 34 and is oriented horizontally. The circumferential plane of the toroid 30 is transverse to the plane of the glass plate 31. The holding assembly 50 may be comprised of two belt subassemblies 51 positioned one over the other in a spaced relationship. The belt subassemblies 51 hold the toroid 30 between them and are adapted to turning thereby advancing the toroid 30. The toroid 30 may have a thin film of pressure sensitive adhesive to help facilitate the accurate positioning of wraps on the toroid 30.

A rotating element 40 is positioned beneath and parallel to the glass plate bottom surface 34. The element 40 is rotated by a drive bar 41 with torque applied by conventional means. The element 40 is rotated in a plane parallel to the plane of the glass bottom surface 34. The rotating element 40 has an upper surface 42 with two opposite ends 43. One end has a magnet 44 fixedly attached thereto. The opposite end has a counter weight 45 attached thereto. The rotating element 40 has means (not shown) for moving the magnet 44 and counter weight 45 closer to each other thereby forming a radially declining circle.

The second end 22 of a conductive wire 20 is attached to the toroid 30. The other end 21 of the conductive wire is attached to a ferrous block 10 as described above. Alternatively, a trailing slug 12 is trapped by the feeder assembly 60 (see below). The casted block 10 or leading slug 11 is placed on the glass plate upper surface 33 by the feeder assembly 60. The drive bar 41 begins to turn thereby rotating the element 40. The magnet 44 magnetically engages the block 10 or leading slug 11 swinging the block 10 or slug 11 with wire 20 attached in a general circular motion A. There is a centrifugal force exerted on the ferrous block 10 or slug 11 swinging it out to the approximate perimeter 35 of the glass plate 31. The block 10 or slug 11 passes through a central 29 opening in the toroid 30. This process continues for a desired period thereby wrapping the conductive wire 20 about the toroid 30.

The winding process is further comprised of a feeder assembly 60 which is adapted to placing the block 10 or leading slug 11 initially through the toroid opening 29 onto to the glass plate upper surface 33. The block 10 or leading slug 11 is then magnetically engaged by the rotating element magnet 44. The feeder assembly 60 is comprised basically of an elongated tube 61 into which the wire 20 with attached elements 10, 11, 12 is inserted. A pneumatic circuit 62 is attached to the tube 61 and provides means for accelerating the prepared wire 20 with attached elements 10, 11, 12 out through the toroid central opening 29. Sensors 65 are positioned at desired locations along the outside of the tube 61. The trailing end 12 is snagged by a trap 63 adjacent the tube exit 64. The prepared wire 20 leading slug 11 is preferably 0.75 inches long and the trailing slug is 0.15 inches long. When the leading slug 11 or 10 is sensed exiting the tube 61, the trap 63 will open allowing the trailing slug 12 to be captured as it exits the tube 61. This will control the position of the wire 20 and create a starting point for the first wrap about the toroid 30.

The glass plate upper surface 33 has a ceramic guide 36 on both sides of the toroid 30. The guides 36 further assist in proper guidance of the leading slug 11 as it passes through the toroid central opening 29.

It is understood that the above-described embodiment is merely illustrative of the application. Other embodiments may be readily devised by those skilled in the art which will embody the principles of the invention and fall within the spirit and scope thereof.

I claim:

1. A method of winding toroid cores comprising the steps of:

attaching a block of ferrous material which has magnetic properties to a first end of a conductive wire;

providing a notched glass plate, said glass plate having an upper surface and a bottom surface, said glass plate laying in a horizontal plane;

placing a toroid having a central opening in a holding assembly adjacent to said notched glass plate, the toroid being positioned within the glass plate notch and positioned in a vertical plane, said toroid having a circumferential plane transverse to the plane of the glass plate;

providing a rotating element positioned beneath and parallel to the glass plate bottom surface, said element being rotated by a drive bar, said element being rotated in a plane parallel to the plane of the glass bottom surface, said rotating element having an upper surface with two opposite ends, one end having a magnet fixedly attached thereto;

attaching a second end of said conductive wire to the toroid;

providing a feeder assembly adapted to placing the block initially through the toroid central opening onto to the glass plate upper surface;

rotating said rotating element wherein said magnet magnetically engages said block, said block moving with said magnet and swinging in a general circular motion out toward the glass plate perimeter, said block passing through said toroid central opening;

continuing rotation of said rotating element until all of said wire is wound about the toroid.

2. A method as recited in claim 1, further comprising the steps of:

cutting the block into a lead slug and a trailing slug wherein said lead slug is attached to said conductive wire first end and said trailing slug is attached to a conductive wire second end.

3. A method as recited in claim 2, wherein the step of attaching a block of ferrous material to a first end of a conductive wire comprises the steps of:

making a concentrated slurry of sponge iron powder in an adhesive;

pouring the slurry into a mold;

passing said conductive wire first end into the mold on center along a mold's longitudinal axis;

applying a magnetic field with a desired magnetic domain and polarization;

removing a resulting ferrous block with conductive wire end attached from the mold.

4. A method as recited in claim 3, further comprising the step of:

providing a magnetically-inert guide on said glass plate upper surface on both sides of the toroid.

5. A method as recited in claim 4, further comprising the step of:

providing a counter weight on said rotating element upper surface on a second opposite end.

6. A method as recited in claim 5, further comprising the step of:

providing means for moving the magnet and counter weight closer to each other thereby forming a radially declining circle.

7. A method as recited in claim 6, wherein the step of providing a feeder assembly comprises the steps of:

providing an elongated tube into which a wire with lead slug and trailing slug is inserted;

providing pneumatic means for accelerating said wire lead slug out through a tube exit through the toroid central opening;

snagging said trailing slug with a trap adjacent to said tube exit;

providing a plurality of sensors along side said tube, said sensors sensing the positions of the lead and trailing slugs within the tube.

8. A method as recited in claim 7, wherein the step of providing a holding assembly comprises the steps of:

providing two belt subassemblies positioned one over the other in a spaced relationship, said belt subassemblies adapted to hold the toroid between them and adapted to turning thereby advancing the toroid.

9. A method as recited in claim 8, further comprising the step of:

applying a thin film of pressure sensitive adhesive to the toroid prior to rotating the rotating element.

* * * * *